US010428480B2

(12) United States Patent
Soni et al.

(10) Patent No.: US 10,428,480 B2
(45) Date of Patent: Oct. 1, 2019

(54) SNOW MELTER MACHINE

(71) Applicants: Chirag D. Soni, Round Lake, IL (US); Kimberly K. Cameron, Monte Sereno, CA (US); Mark A Lewis, Plano, TX (US)

(72) Inventors: Chirag D. Soni, Round Lake, IL (US); Kimberly K. Cameron, Monte Sereno, CA (US); Mark A Lewis, Plano, TX (US)

( * ) Notice: Subject to any disclaimer, the term of this patent is extended or adjusted under 35 U.S.C. 154(b) by 0 days.

(21) Appl. No.: 15/310,392

(22) PCT Filed: Jan. 14, 2016

(86) PCT No.: PCT/US2016/013442
§ 371 (c)(1),
(2) Date: Nov. 10, 2016

(87) PCT Pub. No.: WO2017/123231
PCT Pub. Date: Jul. 20, 2017

(65) Prior Publication Data
US 2018/0044870 A1 Feb. 15, 2018

(51) Int. Cl.
*E01H 5/10* (2006.01)
*E01H 5/02* (2006.01)

(52) U.S. Cl.
CPC ..... *E01H 5/104* (2013.01); *E01H 5/02* (2013.01); *E01H 5/102* (2013.01)

(58) Field of Classification Search
CPC ..... E01H 5/10; E01H 5/102; E01H 5/104; E01H 5/106; E01H 5/108; E01H 5/02
See application file for complete search history.

(56) References Cited

U.S. PATENT DOCUMENTS 197,905 A * 12/1877 Sinclair ..... E01H 5/104 37/228
559,217 A * 4/1896 Ripley ..... E01H 5/102 126/343.5 R
610,180 A * 9/1898 Greenig ..... E01H 5/102 126/343.5 R
636,987 A * 11/1899 Hendryx ..... E01H 5/104 37/227
665,157 A * 1/1901 Zetelle ..... E01H 5/102 126/343.5 R
830,305 A * 9/1906 Cruise ..... E01H 5/102 126/343.5 R
950,413 A * 2/1910 Stedman et al. ..... E01H 5/102 126/343.5 R
961,604 A * 6/1910 Goff ..... E01H 5/102 126/343.5 R (Continued)

FOREIGN PATENT DOCUMENTS

WO WO-2017123231 A1 * 7/2017 ..... E01H 5/02

*Primary Examiner* — Jamie L McGowan
(74) *Attorney, Agent, or Firm* — Charles F. Meroni, Jr.; Meroni & Meroni, P.C.

(57) ABSTRACT

A snow and ice melting device having an insulated chamber a heater located inside the insulated chamber a reservoir located at the distal end of the insulated chamber a pump operationally connected to the reservoir a snow port located at the proximal end of the insulated chamber the snow port comprising a body and a portal between the body and the insulated chamber and a power supply connected to the heater and the pump.

12 Claims, 9 Drawing Sheets

(56) References Cited

U.S. PATENT DOCUMENTS 1,418,630 A * 6/1922 Crouse ..... E01H 5/102
126/343.5 R
1,681,104 A * 8/1928 Earnhardt ..... E01H 5/10
126/271.2 A
2,705,844 A * 4/1955 Pepi ..... E01H 5/104
126/343.5 R
2,820,450 A * 1/1958 Zimmerman ..... E01H 5/106
126/271.2 A
2,977,695 A * 4/1961 Kesecker ..... E01H 5/104
126/343.5 R
3,405,705 A * 10/1968 Devlin ..... E01H 5/104
126/343.5 R
3,484,961 A * 12/1969 Coslowsky ..... E01H 5/104
126/343.5 R
3,766,586 A * 10/1973 Krickovich ..... E01H 1/0845
15/340.3
4,409,957 A * 10/1983 Muhammad ..... E01H 5/102
126/343.5 R
5,140,762 A * 8/1992 Monson ..... E01H 5/106
37/227
5,588,231 A * 12/1996 Mavrianos ..... E01H 5/104
126/343.5 R
5,791,335 A * 8/1998 Luciani ..... E01H 5/102
126/343.5 R
6,353,212 B1 * 3/2002 Smith ..... E01H 5/104
219/533
6,360,738 B1 * 3/2002 Brooks ..... E01H 5/102
126/343.5 R
8,640,687 B2 * 2/2014 Tucker ..... E01H 5/102
126/343.5 R
9,034,184 B2 * 5/2015 Schumm, III ..... C02F 1/32
210/192
9,689,127 B2 * 6/2017 Amani ..... E01H 5/102
9,945,086 B2 * 4/2018 Sanchez ..... E01H 5/102
2007/0006874 A1 * 1/2007 Potter ..... E01H 5/102
126/343.5 R
2009/0282707 A1 * 11/2009 Shenouda ..... E01H 5/106
37/227
2015/0275449 A1 * 10/2015 Sanchez ..... E01H 5/102
432/88
2017/0114511 A1 * 4/2017 Amani ..... E01H 5/102

* cited by examiner

SNOW MELTER MACHINE

FIELD OF THE INVENTION

The present disclosure relates generally snow removal devices, particularly, it is adapted for moving and melting of snow and ice for proper sequestration of the precipitate.

BACKGROUND

During cold weather, and particularly those areas in colder climates, there is typically a significant accumulation of snow and ice along on both public and private property that pose a safety hazard if left unchecked or uncleared. Overnight snowfall and ice accumulation can result in such hazardous conditions for individuals attempting to reach their car or exit their house the morning after a significant snowfall, or freeze. Typical removal techniques include manually shoveling and breaking up thick patches of snow and ice and/or using a motorized snow blowing machine. This can be particularly challenging for those with health concerns, the elderly, and those with physical disabilities. Additionally, there is often only limited space to relocate accumulated snow and ice to, resulting in hazardous "snow mountains" that then can cause property damage when temperatures warm.

Accumulated snow can become heavy and condensed if not immediately cleared, and likewise can become wet or even hardened in moist conditions or in the presence of freezing rain. This further exacerbates the difficulty of physically clearing a pathway or large areas of fallen snow. Even when one uses a snow blower or similar device, the issue of storing large amounts of accumulated snowfall remains, as does the need to maintain the cleared area. Typically this is done using a bed of rock salt to prevent ice formation on the cleared path. However, extremely low temperatures, typically below 20 degrees Fahrenheit (−7° C.), render rock salt ineffective at melting ice.

Conversion of 0° C. snow to 0° C. water requires 334 kJ/kg of snow. The rate at which the domestic power circuit can provide such energy often limits the rate at which a device can be used to melt snow. Assuming a 50 amp circuit of a typical residence, the power available for melting snow is approximately 12.0 kW, which is sufficient to melt 0.03593 kg of snow per second, or 2.16 kg per minute. The density of snow ranges between 5 and 20% of that of water, thus this corresponds to 0.00018 cubic meters of snow per second, or approximately equal to 22.8 cubic feet of snow per hour. However, often in other applications there are significant parasitic conditions leading to a lower efficiency in the task of melting snow such as loss of heat to atmospheric conditions, which the current device design seeks to mitigate. In extreme circumstances with an ambient temperature of −30° C. many devices are incapable of melting snow and ice, whereas the design of the present invention only loses approximately 15% efficiency.

Thus there is a need for, and the present invention provides, a solution to clearing both accumulated snow and ice from pathways and to the problem of storing excess snow after roads or other areas are cleared of snow and ice. The device is useful for melting accumulated snow and transporting it to an area, such as a storm drain, where the water can simply flow away without accumulating and causing the issues related with removal and storage of significant accumulations of snow and ice. The device, therefore, is a powered heating device and pump system that can be moved over areas of snow and ice. It is particularly useful for areas of high snow accumulation, as well as after initial snow removal for transport of excess accumulation, in liquid form, to an area better suited for storage.

BRIEF SUMMARY

The present disclosure relates to a snow melter directed to converting accumulated atmospheric snow into liquid water. The general purpose of the machine is to intake snow and ice and heat it using a heating element powered by electrical means, fossil fuels, or other related means, and output melted water that can be directed to a desired disposal area by the operator.

The snow melter generally comprises, in a preferred embodiment an insulated chamber having a proximal end and a distal end, a heater located inside the insulated chamber, a reservoir located at the distal end of the insulated chamber, a pump operationally connected to the reservoir, a snow port located at the proximal end of the insulated chamber, the snow port comprising a body and a portal between the body and the insulated chamber, at least one axel connected to the insulated chamber, each axel having at least two wheels connected thereto, a power supply connected to the heater and the pump.

In other embodiments the snow and ice melting device may also preferably have the body of the snow port comprising an internal snow ramp, a first spring loaded flap that allows snow to travel to the internal snow ramp, a second spring loaded snow flap which forms a barrier between the snow port and the insulated chamber, and control circuitry for closing and opening the first and second spring loaded flaps. In some embodiments it is preferable to incorporate motion and monitor sensors located inside the snow port, the monitor sensors connected to the control circuitry, capable of detecting the snow charge inside of the snow port, and indicating to close the first spring loaded flap when the snow port is full and simultaneously open the second spring loaded port. In other embodiments the snow port also comprises a snow-blower intake port located at the top of the snow port, a baffle located adjacent the snow-blower intake port and located inside the snow port, and an air escape slit or hole. In other embodiments the snow and ice melting device has a hose attached to the pump for directing snow-melt away from the snow and ice melting device. Sometimes the reservoir has first and second portions, wherein a coarse mesh screen located at the entrance to the reservoir, a fine mesh screen located between the first and second portions of the reservoir; and the pump being connected to the second portion of the reservoir. Preferably, the snow and ice melting device has two handles connected to the proximal end of the body.

In another embodiment, the invention contemplates an apparatus for melting snow and ice having a body, an intake port located at a first end of the body, an output port located at a second end of the body, a heating element located within the body, a pump connected to the output port and located within the body, said pump capable of pumping water from within the body out the output port an exiting the body, and a hopper connected to the intake port on the first end of and outside the body, the hopper capable of intaking snow, ice, or other frozen accumulant and transporting it through the intake port into the body.

Certain variations of previously described embodiments may preferably incorporate an axel connected to the body, two wheels connected to said axel, and two handles connected to the first end of the body. In some embodiments the apparatus also has a hose connected to the output port for directing water and melt towards a desired disposal location. In other embodiments the hopper comprises an input port, a transition chamber flap located within the hopper, and a hot chamber flap located at the intersection of the hopper and the intake port of the body, more specifically, in operation, the transition flap can remain open until a signal is given, the hot chamber flap remaining closed, preventing flow into the body until the signal is given, the transition flap closing and hot chamber flap opening simultaneously when the signal is given thereby preventing excess flow into the body, and the transition flap and hot chamber flap returning to standard configurations when the signal ends. In other preferred embodiments the input port is capable of being compatibly fitted to the output end of a snow blower, and the hopper incorporates a baffle located at the input port to selectively reduce turbulence within the hopper. Preferably the apparatus contains a meltwater reservoir located at the second end of the body, a fine mesh screen located at the entrance to the meltwater reservoir, and a coarse mesh screen located between the fine mesh screen and the body. And may also preferably incorporate the pump located within the meltwater reservoir and pumps filtered water from the reservoir, and the meltwater reservoir sends a signal to the body when it is below a threshold level of water.

In another preferred embodiment the invention contemplates a method for melting snow or ice comprising the steps of, inputting snow or ice into a hopper, transporting snow or ice from the hopper to a body through a port, the body being insulated from the hopper, melting said snow or ice into water within the body using a heating element, transporting said water to a pump, and pumping said water from the body.

In some preferred embodiments the method of claim also contemplates filtering said water using coarse and fine filters and transporting the water to a water reservoir prior to pumping said water. The hopper preferably has an input port, a transition chamber flap located within the hopper, a hot chamber flap located at the intersection of the hopper and the intake port of the body, the transition flap remaining open until a signal is given, the hot chamber flap remaining closed, preventing flow into the body until the signal is given, the transition flap closing and hot chamber flap opening simultaneously when the signal is given thereby preventing excess flow into the body, and the transition flap and hot chamber flap returning to standard configurations when the signal ends. In some embodiments the method also contemplates the meltwater reservoir outputting a signal to the transition and hot chamber flaps when the water level is below a threshold value. The method also contemplates the heating element further comprises a thermometer and outputs the signal transition and hot chamber flaps when the temperature within the body crosses a threshold value.

DESCRIPTION OF THE DRAWINGS

The present invention may be better understood, and its numerous objects, features, and advantages made apparent to those skilled in the art by referencing the accompanying drawings.

DETAILED DESCRIPTION

The snow melter machine and apparatus of the present disclosure generally consists of a body, preferably an insulated body, that houses a several components directed to transporting and melting snow and ice, followed by transporting the melted water to a place where it can be more easily stored in liquid water form. In more sophisticated models the body houses electrical components such as signaling relays, feedback mechanisms, thermometers, various pressure monitoring devices, volumetric measuring devices, and other components. The present disclosure discloses new and improved structural features for snow removal and ease of transport. Particularly the performance, durability, workability, and convenience of the present device is not present in other snow removal devices currently on the market as they cannot be used to relocate large amounts of snow and ice in a liquid form to a desired location. Also, due to the relatively compact and lightweight design, the snow melter machine of the present disclosure represents a significant advancement in ease of use over other, similar devices.

Figure 1:
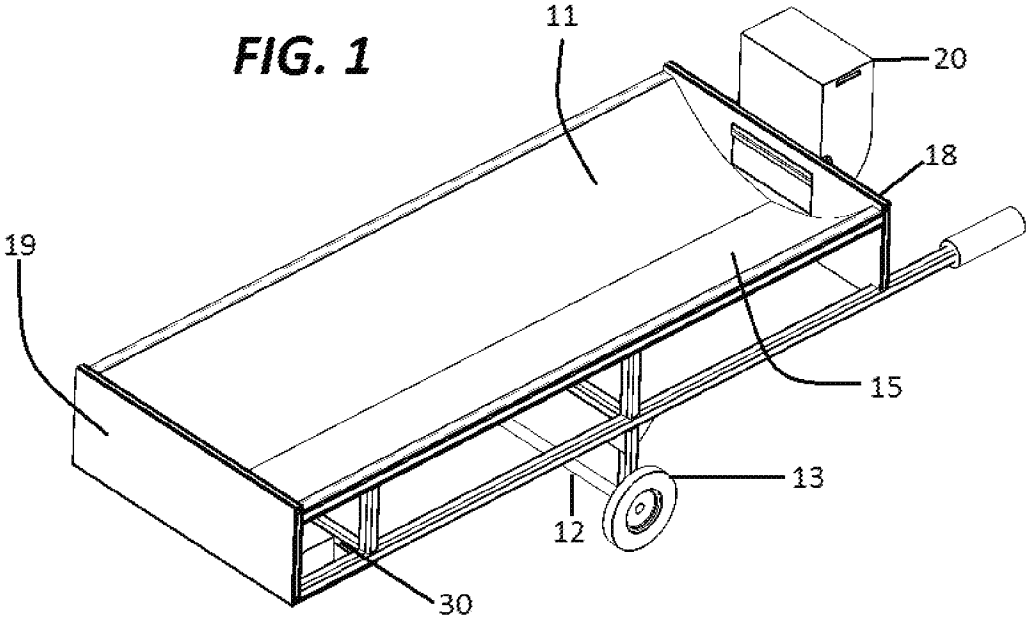
FIG. 1 is a perspective view of an embodiment of a preferred embodiment of a snow melter according to the present invention.

Referring now to FIG. 1, a preferred embodiment of snow removal machine 10 of the present disclosure includes a body 11, snow input port 20 located at proximal end 18, reservoir area 30 located at distal end 19, axel 12 and wheels 13. Within body 11 resides snow compartment 15 which also functions as a heating element in certain preferred embodiments. The body 11 also may have handles 14 for better control of the device 10 and use in combination with wheels 13.

Looking now with more specify to FIGS. 5, 6, 8, 9 snow input port or hopper 20 preferably comprises at least snow inlet 21 and an output (closes at 25) to main body 11 and compartment 15. In a preferred embodiment, inlet 21 is specifically adapted to complement the output of a conventional snowblower, easing the operation of the device, in such an embodiment the port 20 comprises a baffle 22 and an air flow exit slit 27, such devices causing snow to be deflected downward and into the remaining space in the snow input port 20 while quickly moving air flows through the exit slit 27 to allow for smooth flow from the snowblower. In other embodiments port 20 has a removable top 28 making it more compatible with traditional snow removal devices such as shovels. In a preferred embodiment, port 20 also comprises actuating flaps 23, 25 and ramp 24. Transition chamber flap 23 and hot chamber flap 25 can preferably be spring loaded or mechanically actuated. When mechanically actuated flaps 23, 25 may preferably be independently actuatable or may move simultaneously in response to a signal. In a preferred embodiment, the transition flap 23 remains open until a signal is given by the user or by an automatic signal based on outside measurements and the hot chamber flap 25 remains closed (as show in FIG. 9), preventing flow from port 20 into the main body 11. Upon signaling, the transition flap 23 closes and hot chamber flap 25 opens thereby preventing additional flow of snow and ice into the space 29 defined by flaps 23, 25 and ramp 24 while snow and ice in such space flows into the heated chamber 15. After space 29 is cleared, flap 25 closes, and flap 23 opens allowing additional flow of snow and ice into space 29. Preferably, in certain embodiments, monitor sensors connected to control circuitry, capable of detecting the snow charge inside of the snow port 20 are built into the port. These sensors and control circuits are preferably paired to the mechanically actuated flaps 23, 25.

Figure 2:
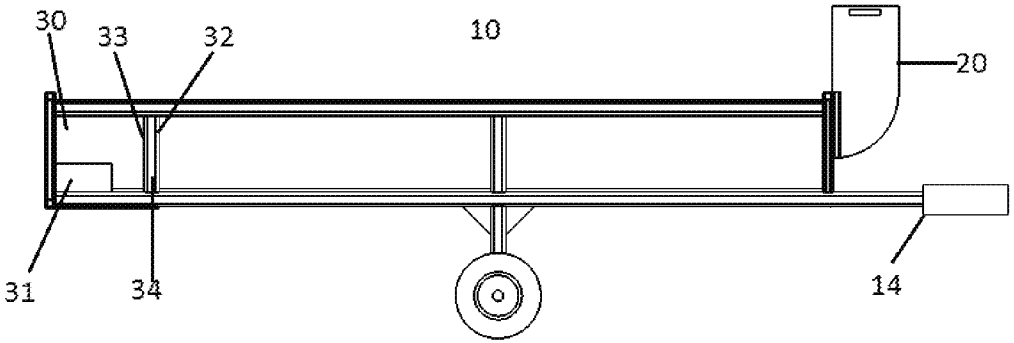
FIG. 2 is a side elevation view of the side of the snow melter of FIG. 1.
Figure 3:
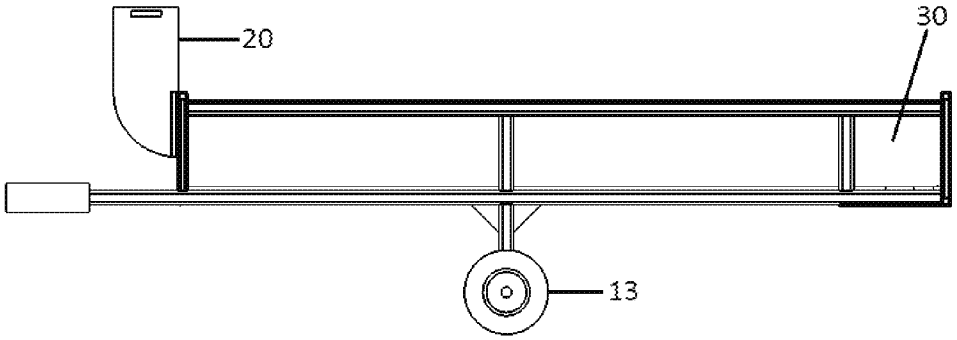
FIG. 3 is a is a reverse side elevation view of the top of the snow melter of FIG. 2.
Figure 4:
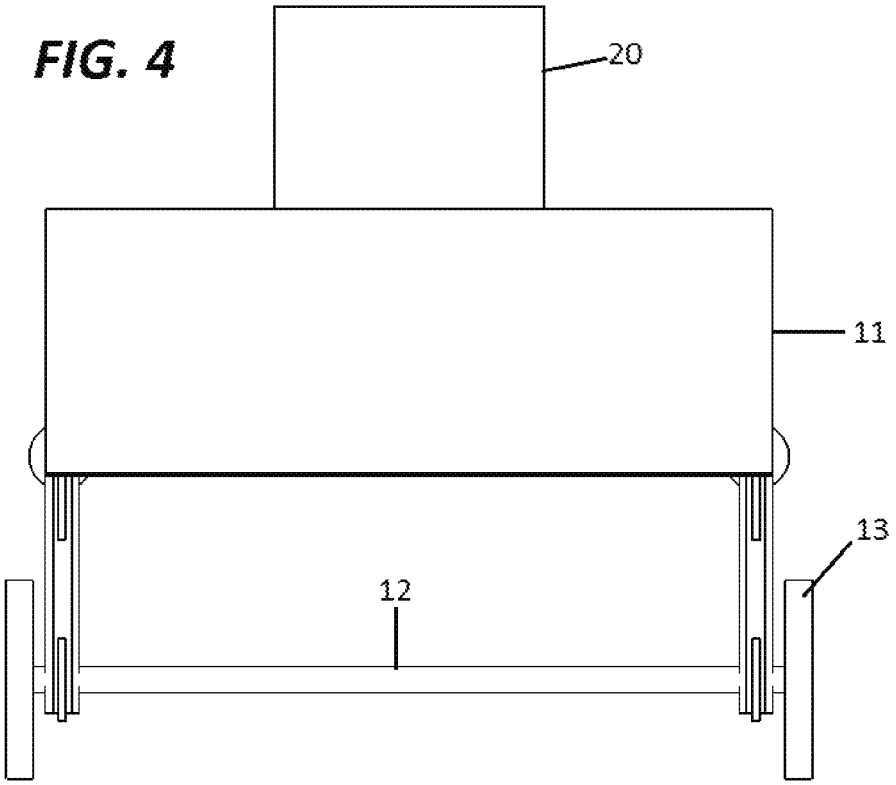
FIG. 4 is a side elevation view of the front of the snow melter of FIG. 1.
Figure 5:
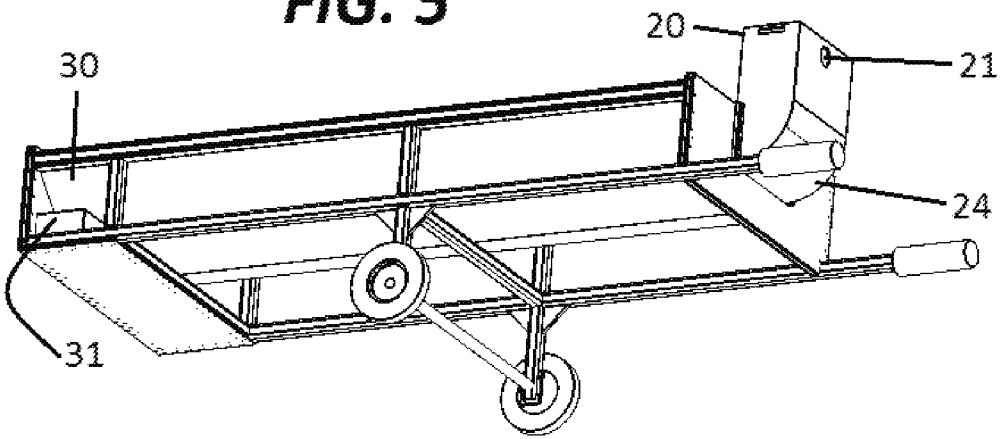
FIG. 5 is a perspective view from a low elevation of the snow melter of FIG. 1.
Figure 6:
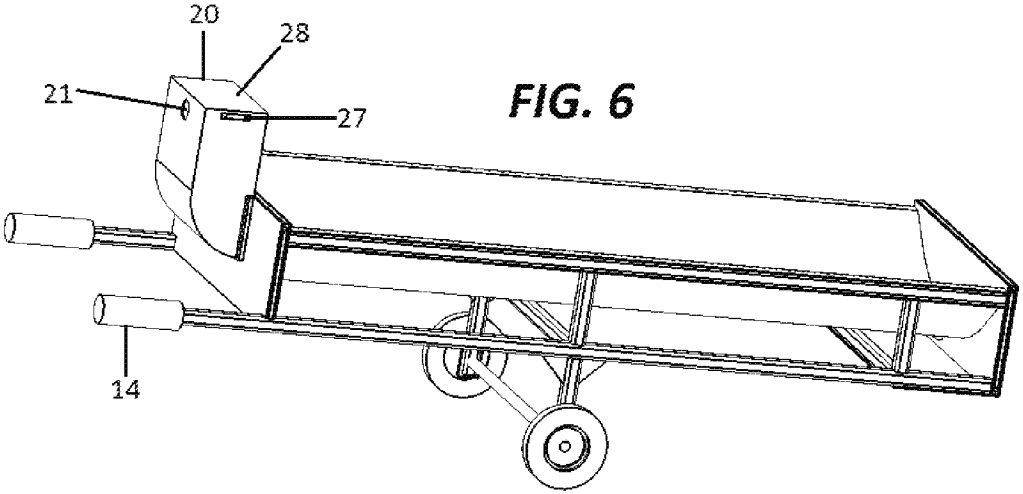
FIG. 6 is a reverse perspective view of the snow melter of FIG. 1.
Figure 7:
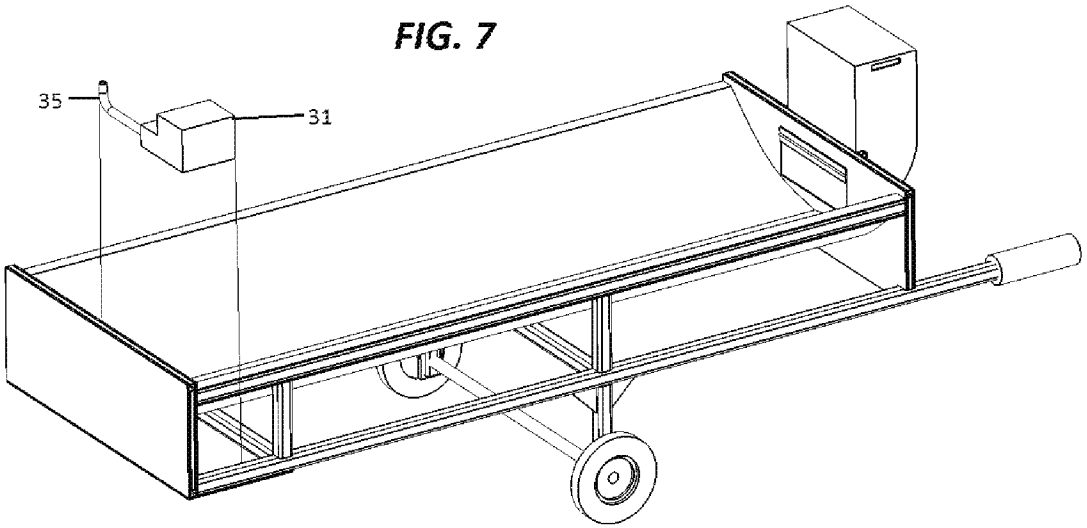
FIG. 7 is a semi-exploded view of the snow melter of FIG. 1 with the pump element separated from the body of the snow melter.
Figure 8:
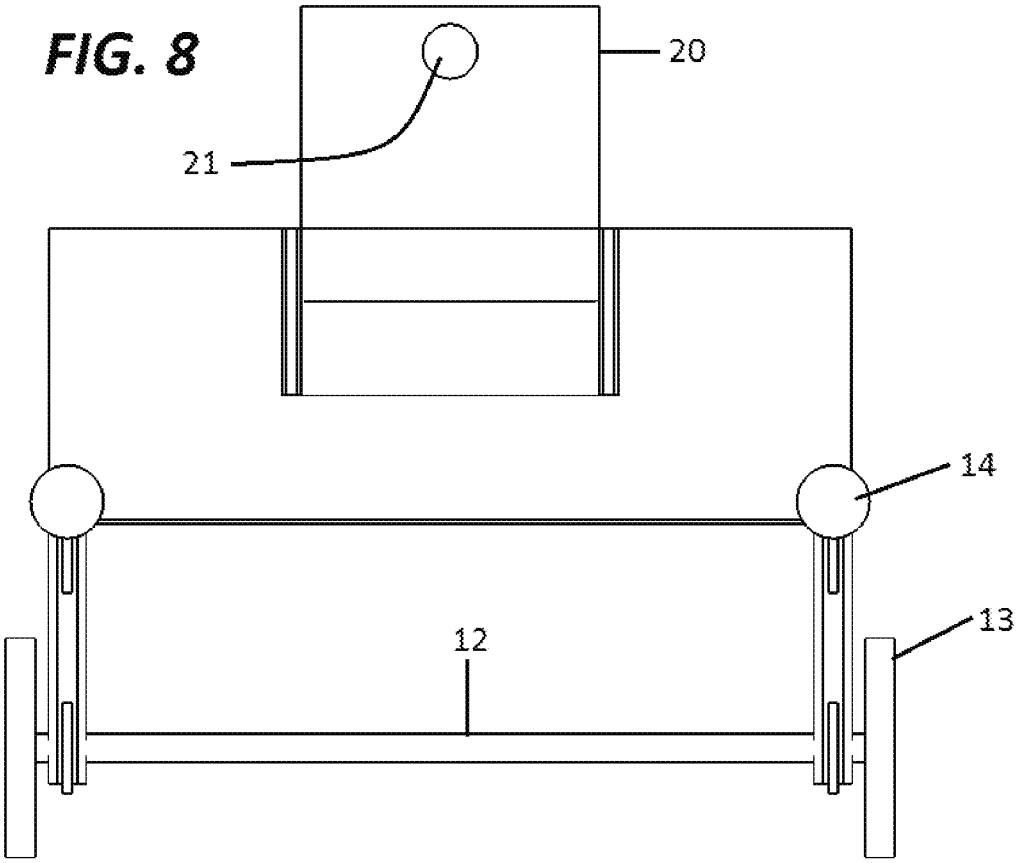
FIG. 8 is a side elevation view of the back of the snow melter of FIG. 1.
Figure 9:
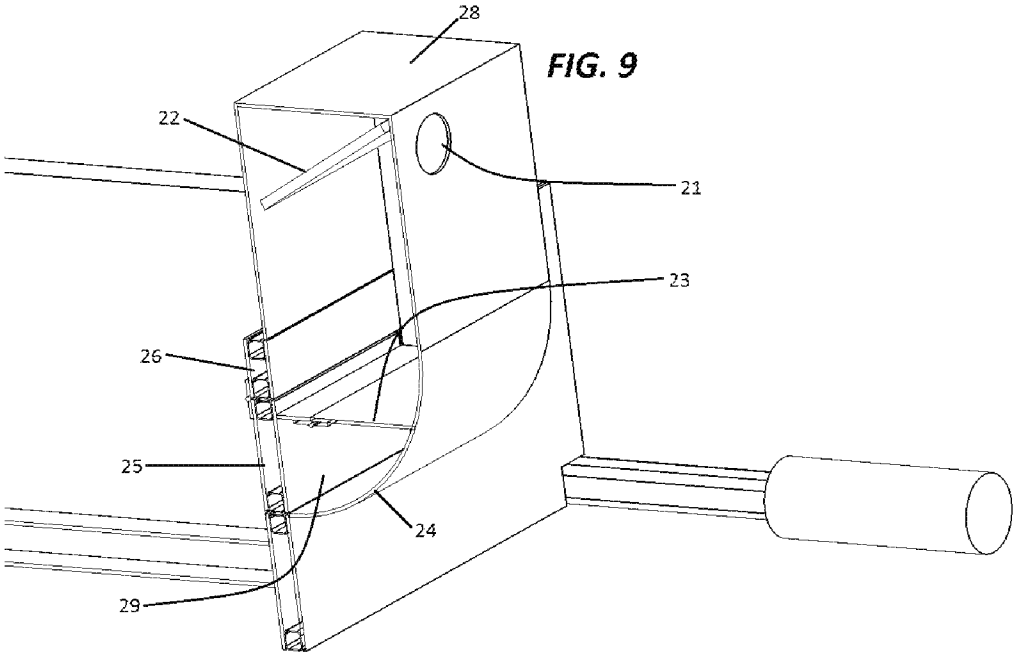
FIG. 9 is a perspective view of back of a preferred embodiment of a snow intake port for a snow melter machine.

Looking now to FIGS. 2, 5, 7 reservoir area 30 is shown in greater detail. Reservoir area 30 preferably contains a pump 31, which is capable of pumping melted snow and ice out of body out through hose 35. In certain embodiments reservoir area 30 comprises two screens 32, 33 which define a secondary buffering area 34. Screen 32 is preferably a coarse screen for filtering out large rocks, sticks, unmelted ice, and other solids and screen 33 is preferably a fine screen for filtering sand and other smaller solids. Screens 32, 33 are preferably removable for simple cleaning of the device after use and for preventing corrosion of the screens. In certain preferred embodiments the meltwater reservoir 30 contains a volumetric measuring device that measures the levels of meltwater within the reservoir. In such embodiments water levels may selectively signal to control circuits located elsewhere in the snow melting machine 10, specifically, the transition 23 and hot chamber 25 flaps may preferably move in response to water levels in the reservoir are below a certain threshold level. Volumetric monitors may also selectively control operation of the pump 31, which may be selectively shut off when water levels are below a threshold level to conserve energy and heat.

Looking now to the specific operation of the snow melting machine 10, the machine may be adapted to operation with a 240 volt domestic electronic circuit, or adapted to use with a gasoline engine. The machine's general structure relates to the body 11, and insulated chamber 15, wherein snow charge input through snow port 20 is melted using a infrared radiant heater. Insulated chamber 15 is preferably surrounded by high-performance furnace insulation with very low thermal conductivity. The thickness of such insulation is selected to minimize power loss to the atmosphere. Preferably the heater or heating element is a 13.5 kW infrared heater and is powered by a 240, 50 am electrical circuit. In certain embodiments, portable means of providing electricity to the snow melting machine are also contemplated, such as portable electronic generators.

The machine's snow port 20 is at the proximal end of a tilted, internal snow "ramp" formed within body 11 and insulated chamber 15 which allows energy to be saved by virtue of the operation of gravity. Within the snow port 20 and chamber 15, monitor sensors detect snow charge and servo control circuitry closes flap 23 and opens flap 25 allowing snow to pass into chamber 15. Flap 25 then is closed and the radiant heater or heating element is energized and remains energized until monitor sensors indicate no solid snow remains in chamber 15. Water then drains from chamber 15 into reservoir 30 through gratings 32, 33 and to pump 31. Pump 31 is preferably an electric pump operated by a level switch in the reservoir and transfers water to a domestic drain or other disposal area preferably through a hose 35.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

We claim:

1. A snow and ice melting device comprising:

An outer shell;

an insulated chamber located inside the outer shell having a proximal end and a distal end;

a heater located inside the insulated chamber;

a reservoir located at the distal end of the insulated chamber;

a pump operationally connected to the reservoir;

a snow port located at the proximal end of the insulated chamber;

the snow port comprising a body and a portal between the body and the insulated chamber;

at least one axel connected to the insulated chamber, each axel having at least two wheels connected thereto;

a power supply connected to the heater and the pump; and the body of the snow port comprises an internal snow ramp, a first spring loaded flap that allows snow to travel to the internal snow ramp, a second spring loaded snow flap which forms a barrier between the snow port and the insulated chamber, and control circuitry for closing and opening the first and second spring loaded flaps.

2. The snow and ice melting device of claim 1 further comprising:

motion and monitor sensors located inside the snow port;

the monitor sensors connected to the control circuitry, capable of detecting the snow charge inside of the snow port, and indicating to close the first spring loaded flap when the snow port is full and simultaneously open the second spring loaded port.

3. The snow and ice melting device of claim 1 further comprising:

a snow-blower intake port located at the top of the snow port;

a baffle located adjacent the snow-blower intake port and located inside the snow port; and an air escape slit or hole.

4. The snow and ice melting device of claim 1 further comprising:

a hose attached to the pump for directing snowmelt away from the snow and ice melting device.

5. The snow and ice melting device of claim 4 further comprising:

the reservoir having first and second portions;

a coarse mesh screen located at the entrance to the reservoir;

a fine mesh screen located between the first and second portions of the reservoir; and the pump being connected to the second portion of the reservoir.

6. The snow and ice melting device of claim 1 further comprising:

two handles connected to the proximal end of the body.

7. An apparatus for melting snow and ice comprising:

a body;

an intake port located at a first end of the body;

an output port located at a second end of the body;

a heating element located within the body;

a pump connected to the output port and located within the body, said pump capable of pumping water from within the body out the output port an exiting the body;

a hopper connected to the intake port on the first end of and outside the body, the hopper capable of intaking snow, ice, or other frozen accumulant and transporting it through the intake port into the body;

an axel connected to the body;

two wheels connected to said axel;

two handles connected to the first end of the body;

a hose connected to the output port for directing water and melt towards a desired disposal location;

the hopper having an input port, a transition chamber flap located within the hopper, and a hot chamber flap located at the intersection of the hopper and the intake port of the body;

the transition flap remaining open until a signal is given;

the hot chamber flap remaining closed, preventing flow into the body until the signal is given;

the transition flap closing and hot chamber flap opening simultaneously when the signal is given thereby preventing excess flow into the body; and the transition flap and hot chamber flap returning to standard configurations when the signal ends.

8. The apparatus of claim 7 wherein:

the input port is capable of being compatibly fitted to the output end of a snow blower;

and the hopper further comprises a baffle located at the input port to selectively reduce turbulence within the hopper.

9. The apparatus of claim 7 further comprising:

a meltwater reservoir located at the second end of the body;

a fine mesh screen located at the entrance to the meltwater reservoir; and a coarse mesh screen located between the fine mesh screen and the body.

10. The apparatus of claim 9 wherein:

the pump is located within the meltwater reservoir and pumps filtered water from the reservoir;

and the meltwater reservoir sends a signal to the body when it is below a threshold level of water.

11. A method for melting snow or ice comprising:

inputting snow or ice into a hopper;

transporting snow or ice from the hopper to a body through a port, the body being insulated from the hopper;

melting said snow or ice into water within the body using a heating element;

transporting said water to a pump;

pumping said water from the body;

filtering said water using coarse and fine filters and transporting the water to a water reservoir prior to pumping said water;

and wherein the hopper has an input port, a transition chamber flap located within the hopper, a hot chamber flap located at the intersection of the hopper and the intake port of the body, the transition flap remaining open until a signal is given, the hot chamber flap remaining closed, preventing flow into the body until the signal is given, the transition flap closing and hot chamber flap opening simultaneously when the signal is given thereby preventing excess flow into the body, and the transition flap and hot chamber flap returning to standard configurations when the signal ends.

12. The method of claim 11 wherein:

the heating element further comprises a thermometer and outputs the signal to the transition flap and hot chamber flap[s] when the temperature within the body crosses a threshold value.

* * * * *